US005363293A

United States Patent [19]

Lasker

[11] Patent Number: 5,363,293

[45] Date of Patent: Nov. 8, 1994

[54] AREA LIGHTING SYSTEM FOR NEAR UNIFORM ILLUMINATION OF A SQUARE HORIZONTAL SURFACE AREA WITHOUT SIDE GLARE AND INCLUDING A HORIZONTALLY-ORIENTED ARC TUBE LAMP

[75] Inventor: Martin L. Lasker, Edison, N.J.

[73] Assignee: USI Lighting, Inc., San Leandro, Calif.

[21] Appl. No.: 227,780

[22] Filed: Apr. 14, 1994

[51] Int. Cl.[5] ..... F21V 7/09

[52] U.S. Cl. ..... 362/302; 362/261; 362/298; 362/346

[58] Field of Search ..... 362/261, 297, 298, 300, 362/302, 304, 346

[56] References Cited

U.S. PATENT DOCUMENTS

| | | | |
|---|---|---|---|
| 2,356,592 | 8/1944 | Kolbert et al. | 362/302 |
| 3,215,829 | 11/1965 | Collins et al. | 362/302 |
| 3,329,812 | 7/1967 | Harling | 362/302 |
| 4,002,894 | 1/1977 | Kintz | 362/261 |
| 5,134,557 | 7/1992 | Gordin et al. | 362/261 |

*Primary Examiner*—Richard R. Cole

*Attorney, Agent, or Firm*—Thomas E. Schatzel

[57] ABSTRACT

An embodiment of the present invention is a luminaire for roughly uniform illumination of a square area without side glare. The luminaire uses a horizontally oriented arc tube lamp. A basket reflector surrounds the arc tube lamp and directs light out in a square pattern. A top aperture in the basket reflector is opposite to the illuminated square area. A bottom aperture, positioned in the basket reflector, permits light from the arc tube lamp to pass out to the illuminated square area. A center reflector is centrally positioned above the top aperture and has bow-tie shaped body and a pair of ends that are orthogonally oriented to the arc tube lamp. A pair of side reflectors with a plurality of faceted reflective surfaces receive light from the arc tube lamp that has been reflected from the center reflector. The side reflectors are positioned at opposite points outside the basket structure and are centered along a line perpendicular to the arc tube lamp. A pair of tertiary reflectors are respectively disposed between the basket structure and the side reflectors and each have two reflective surfaces for directing light from the middle faceted reflective surfaces of the side reflectors out along the axis of the arc tube lamp.

12 Claims, 6 Drawing Sheets

AREA LIGHTING SYSTEM FOR NEAR UNIFORM ILLUMINATION OF A SQUARE HORIZONTAL SURFACE AREA WITHOUT SIDE GLARE AND INCLUDING A HORIZONTALLY-ORIENTED ARC TUBE LAMP

BACKGROUND OF THE INVENTION

1. Field of the Invention

The present invention relates generally to lighting systems, and more specifically to luminaires for uniform intensity area lighting with controlled side glare.

2. Description of the Prior Art

Light intrusion has become an important concept in the lighting industry. Light from lamps must now be controlled so that only the area meant to be illuminated is illuminated by the lamp and outside area is not. For example, in a perfect street lamp implementation, no glow from a lamp should be visible from above or the sides of the designated area. Diffraction and scatter in prior art luminaires have allowed light, and thus the power to make the light, to be wasted by the inability to avoid direct light rays out the sides. Ordinances and industry practices frequently exist to prevent such side emissions for various reasons, for example, to make driving safer and to save on energy costs.

An improved roadway luminaire is described by the present inventor, Martin L. Lasker, in U.S. Pat. 4,651,260, (Lasker '260), issued Mar. 17, 1987. A source of light is reflected out from the luminaire by side-by-side reflectors, one of which is to one side of the light source. The light from the other reflector is adjusted to reinforce light coming from the second reflector in a preferred direction. Some prior art optical systems use a first reflector which surrounds a horizontal lamp in a standard Type II–III (roadway), "sharp cutoff" configuration. In Lasker '260, a part of this reflector causes an overly intense "hot spot", that increases in intensity as the angles of light move closer to the nadir at the base of the mounting pole. A subsequent redirection of the light escaping through this opening is accomplished by a second reflector which distributes otherwise wasted light at higher, more productive angles. The contour of the second reflector is such that no light above the cutoff angle of the first reflector occurs, so that the "sharp cutoff" of glare is retained. At least one lighting system described in the prior art uses a somewhat different approach to produce a Type V distribution with a vertical lamp, but both systems have the same basic problem. The high angle distribution from the second reflector has to pass through a clear side wall to keep the fixture within a practical size. Due to natural imperfections in the specular surface of the second reflector and in the material of the clear side walls, the luminaire appears to glow, despite is sharp cutoff of glare. It emits light at all angles, even those above 90° from nadir.

FIGS. 1 and 2 illustrate a pair of light distribution patterns 10 and 12, shown in plan view, for the industry standard classifications "type V" and "square type V", respectively. Both have a luminaire 14 and 16 positioned in the center of the light-pattern. The square type V distribution 12 bulges out at the corners to fill a more rectangular pattern.

FIG. 3 shows the light distribution pattern 12 superimposed-over a grid of squares each having a side equal to one "mounting height" (MH), where one mounting height is the height of a luminaire above ground. Pattern 12 extends out three mounting heights on all four sides of the luminaire, e.g., where the luminaire is mounted thirty feet above the ground and three mounting heights would be ninety feet. The luminaire 16 is represented with an oblong bar positioned as with an arc tube of a horizontally held lamp.

FIG. 4 shows four illuminated areas, such as pattern 12, abutting each other as is typical in a typical large parking lot application.

FIG. 5 is an elevation view of the luminaire 16 and a pole 18 beneath it. Vertical angles from nadir (Point N) are shown that are required to reach points A, B, C and V, where "V" includes a plurality of points V beyond point C, as in FIG. 3. An important function of an optical system in an area lighting application permits the widest spacing between poles while not exceeding a ratio of ten to one between the brightest and dimmest points on the ground. Such a ratio is considered to define the bounds of uniform illumination. A good optical system should also sharply reduce the intensity of light at angles above 80° to eliminate glare that can impede vision, light intrusion onto nearby properties and other forms of light pollution.

Lamps with an elongated arc tube, e.g., high pressure sodium and metal halide lamps used for area lighting, direct their greatest intensity of light perpendicular to the axis of the arc tube, a direction referred to as "broadside". The intensity becomes progressively weaker as the lamp (arc tube) is viewed from an on-end angle. The light falling on a point "A" in FIG. 5 comes from the broadside of the arc tube and therefore is at its greatest intensity. Not much additional light from the reflector system is required to effectively illuminate point A. A pair of points "B" and "B1" represent the weakest, on-end view of the lamp, therefore most of the light required at these points must come from a reflector system. A point "C", in FIG. 5, views the arc tube in an intermediate, foreshortened position, with a light intensity level between that at broadside and on-end.

However, point C is more distant from the luminaire 16, compared to points A and B, further diminishing the light level. As a result a larger amount of reflected light is required at point C for effective illumination. In order to strike the ground at point C, light must be projected at a vertical angle of 77°, only a few degrees below the angle at which a viewer standing at a point "V" should see relatively little light from the luminaire 16. This requirement is termed glare cutoff. At a point "N" (nadir), the arc tube broadside is closest. This is usually the maximum point of illumination, e.g., a hot-spot, against which a minimum point, such as points B or C, is compared for the 10:1 maximum/minimum relationship. It is therefore preferable that no light from the reflector be aimed at or near this point.

FIGS. 6 and 7 illustrate the performance of the two best performing systems designed for use in an opaque housing (that is, a luminaire housing which blocks light on all sides except the bottom aperture). A horizontal lamp system 30 has an arc tube 32 in a horizontal position. Because of this horizontal positioning, the tube 32 can be completely recessed in a housing 34 with a reflector 36 to provide a cutoff of direct light at angles above 80°, yet still be sufficiently exposed to provide direct light at angles below 80°. System 30 has a few shortcomings that include a weak on-end and foreshortened views.

FIG. 8 illustrates the relative directions to points B and C (as in FIG. 5). These directions also face the surfaces of the reflector 36 and so the reflector too contributes to the illumination of these points. No matter how much light is redirected by the reflector 36, there is simply not enough cumulative intensity to provide an adequate level of illumination at all of the minimum points to allow very wide luminaire-to-luminaire spacing. A hot-spot at nadir also results from an intense direct broadside of the arc tube 32. Point N therefore receives an excessive accumulation of stray light from the generally wasteful surface of the reflector 36 above the lamp, because it also sees the broadside of the tube 32. For these reasons, the horizontal lamp system 30 cannot produce uniform illumination when spaced apart on a grid much more than five mounting heights by five mounting heights.

In FIG. 7, a vertical lamp system 40 has a broadside and on-end orientation which is better adapted to the desired distribution. However, the vertical length of the arc tube works against the system in other ways. In order to expose a sufficient portion of the arc tube so that it shines directly on point C, the lamp has to be dropped below the aperture. This position creates excessive brightness above 80° both directly from the arc tube and from unavoidable reflections. The only way to restore glare control is to raise the lamp back into the housing where it can no longer produce a wide throw of light. Because of this the vertical lamp system is commonly offered for sale in two mutually exclusive configurations; either for wide spacing (six mounting heights by six mounting heights) without glare controls, or for glare control with much narrower spacing capability.

Two United States Patents describe devices for solving the problem of providing both uniform illumination on wide spacing and glare control, the vertical lamp described by Contra/Cline in U.S. Pat. No. 4,096,555, and the horizontal lamp described by Strada in U.S. Pat. 4,651,260. Both of these systems require that some of the light be emitted through the sides of the luminaire enclosure and therefore can not work with an opaque housing. However, the Strada patent has a reflector configuration that is useful in an improved system.

SUMMARY OF THE PRESENT INVENTION

It is therefore an object of the present invention to provide a luminaire for square pattern illumination of a area capable of a six times mounting height grid array spacing.

It is a further object of the present invention to provide a luminaire with uniform appearing light levels on the ground that do not exceed a ratio of ten to one between maximum and minimum points.

It is a still further object of the present invention to provide a luminaire with a glare cutoff of approximately 80° from its nadir.

It is an object of the present invention to provide a luminaire that can use a flat glass lens and that does not have sidewalls which can leak out light.

It is another object of the present invention to provide a luminaire that is economical to manufacture and to operate.

Briefly, an embodiment of the present invention is a luminaire for roughly uniform illumination of a square area without side glare. The luminaire uses a horizontally oriented arc tube lamp. A basket reflector surrounds the arc tube lamp and directs light out in a square pattern. A top aperture in the basket reflector is opposite to the illuminated square area. A bottom aperture is positioned in the basket reflector and permits light from the arc tube lamp to pass out to the illuminated square area. A top reflector is centrally positioned above the basket reflector. A lens frame .reflector surrounds the aperture of the luminaire below the basket reflector. A center reflector is centrally positioned above the top aperture and has bow-tie shaped body and a pair of ends that are orthogonally oriented to the arc tube lamp. A pair of side reflectors with a plurality of faceted reflective surfaces receive light from the arc tube lamp that has been reflected from the center reflector. The Side reflectors are positioned at opposite points outside the basket structure and are centered along a line that is perpendicular to the arc tube lamp. A pair of tertiary reflectors are respectively disposed between the basket structure and the side reflectors and each have two reflective surfaces for directing light from the middle faceted reflective surfaces of the side reflectors out along two opposite directions of the axis of the arc tube lamp.

An advantage of the present invention is that it provides a luminaire that will simultaneously illuminate a relatively large square area and minimize stray side glare.

An advantage of the present invention is that it provides a luminaire that has a substantially sharp cutoff of light at below 90° from nadir and provides a near uniform intensity of light over its service area.

These and other objects and advantages of the present invention will no doubt become obvious to those of ordinary skill in the art after having read the following detailed description of the preferred embodiment which is illustrated in the various drawing figures.

IN THE DRAWINGS

Figure 9:
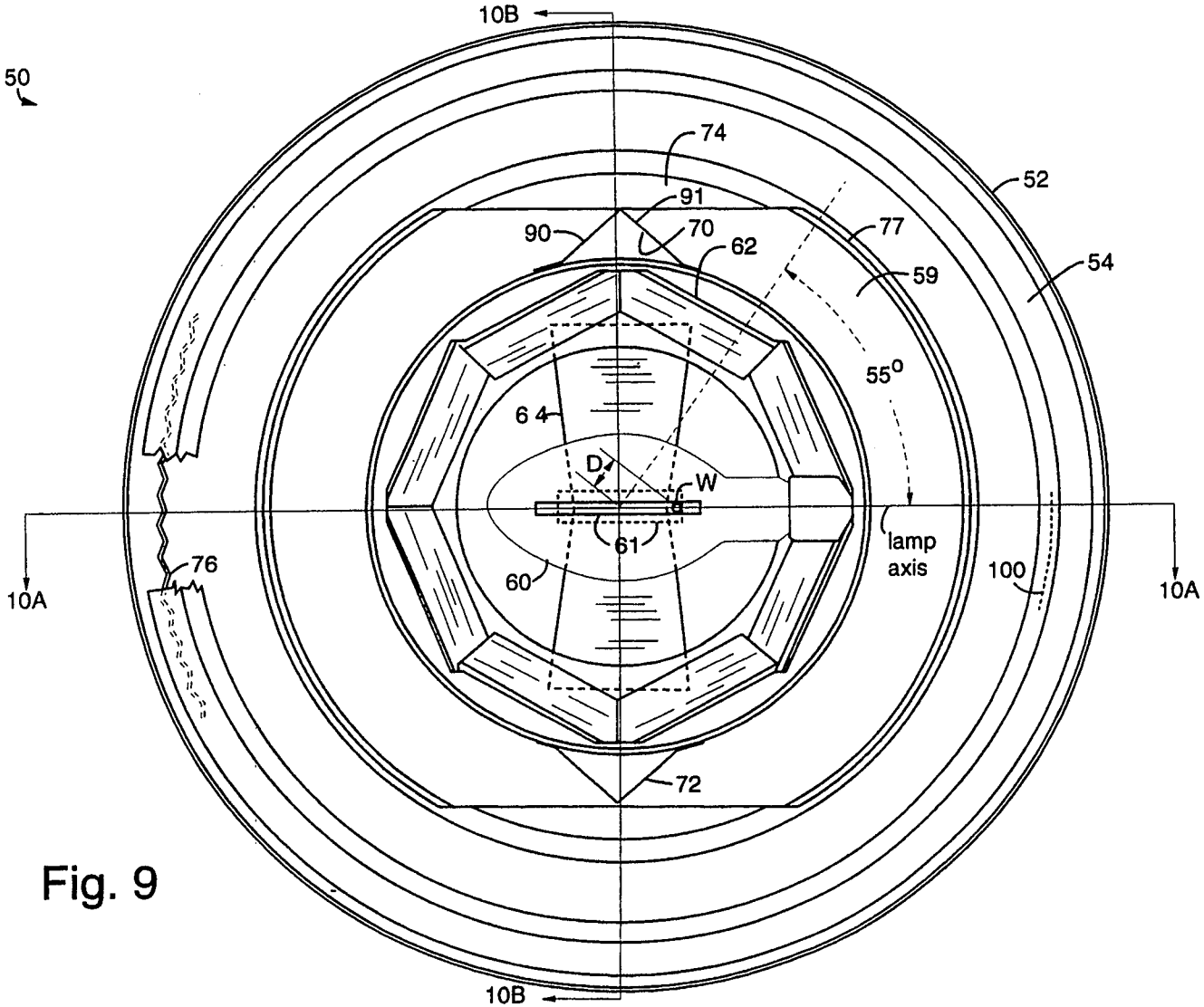
Figure 10A:
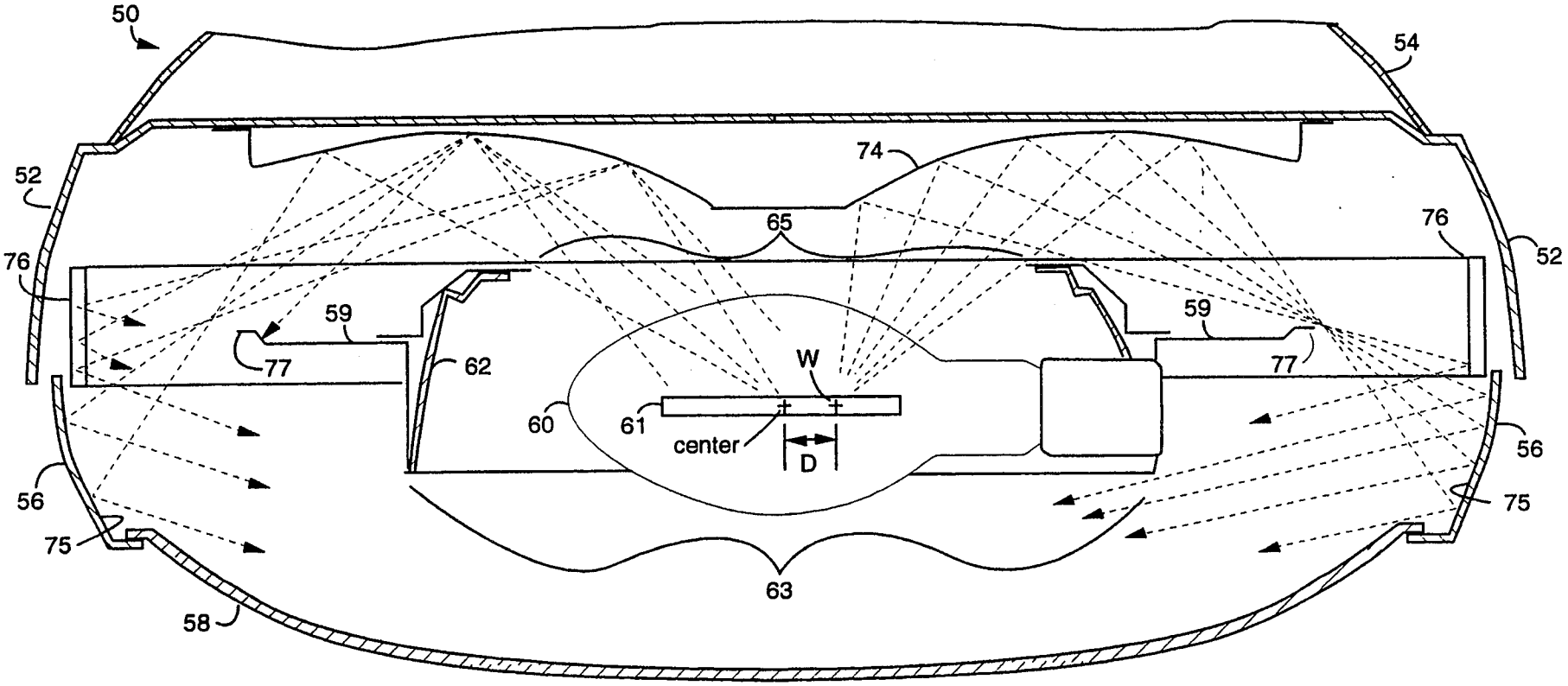
Figure 10B:
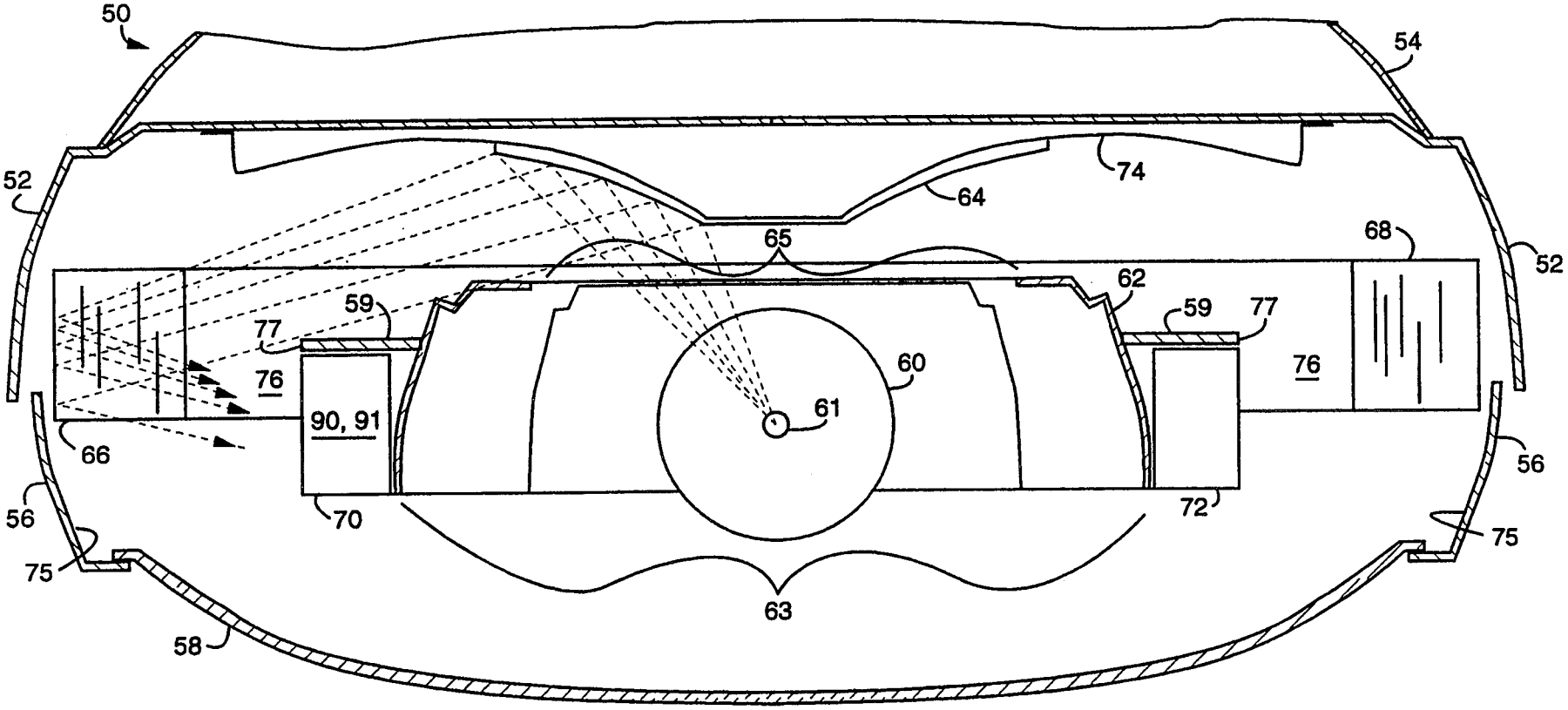
Figures 11A, 11B:
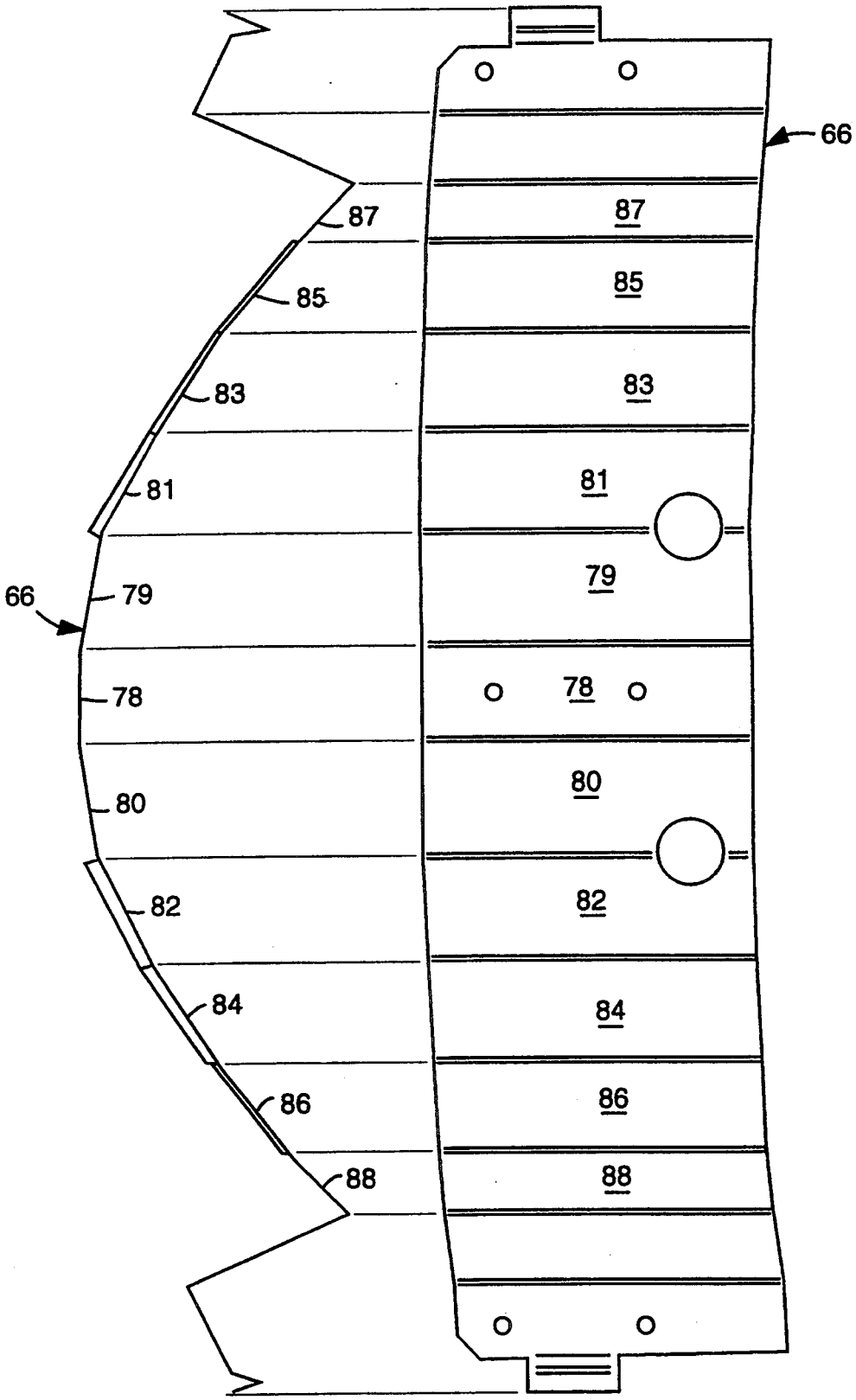

FIG. 9 is a bottom elevation of the luminaire of FIG. 10B with portions of the luminaire at the top and bottom of the drawing not shown to conserve drawing space and drawn without the lens ring and lens ring reflector to show the details of the side and tertiary reflectors and drawn with the plane of the drawing situated to be parallel to the plane of a square area to be illuminated by the luminaire;

FIG. 10A is a middle cross-sectional view of the luminaire of FIG. 9 taken along the axis of the lamp and along the line 10A—10A;

FIG. 10B is a middle cross-sectional view of the luminaire of FIG. 9 taken along the line 10B—10B, which is normal to the line 10A—10A;

FIG. 11A is side view of one of the side reflectors of the luminaire of FIG. 9; and FIG. 11B is a front view of the specular faceted surface of the side reflector of FIG. 11A.

DETAILED DESCRIPTION OF THE PREFERRED EMBODIMENTS

FIGS. 9, 10A and 10B illustrate a luminaire embodiment of the present invention, referred to by the general reference numeral 50, for near uniform lighting of an area, e.g., with four luminaires spaced apart six times their mounting heights in a square grid arrangement. A minimum to maximum lighting ratio of ten to one is considered by the human eye to be near uniform, and is therefore an objective in applications of the luminaire 50.

Luminaire 50 is an area lighting system which includes a main housing 52, a top housing 54, a bottom housing 56, a clear lens 58 and a blocking wall 59. Lens 58 and bottom housing 56 are not shown in FIG. 9 so that the details of the system of reflectors may be more clearly illustrated. An arc tube lamp 60 provides a high intensity source of light that is configured as a light source line segment 61 and is typically sized from 400 watts to one kilowatt. FIG. 9 shows segment 61 in two alternative dimensions that represent the range of wattage sizes possible. Lens 58 is shown in FIGS. 10A and 10B as sagging or drooping away from lamp 60 and, as such, its curvatures allow light from lamp 60 to exit downward from luminaire 50 at angles approaching 80° from the vertical.

Light from lamp 60 at angles higher than 80°, relative to nadir, which is commonly called "side glare", is prevented from escaping luminaire 50.

Figure 1:
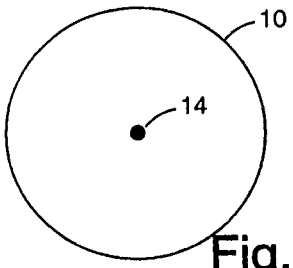
FIG. 1 illustrates a light distribution pattern in plan view for the industry standard classification "type V"
Figure 2:
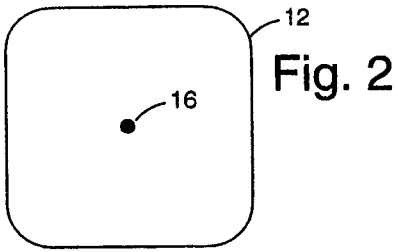
FIG. 2 illustrates a light distribution pattern in plan view for the industry standard classification "square type V"

Luminaire 50 further includes a basket reflector 62 with a bottom aperture 63. The basket reflector 62 forms the light emitted from lamp 60 into a square pattern on a surface generally planar and parallel to lens 58, e.g., pattern 12 in FIG. 2. For example, U.S. Pat. No. 4,651,260, issued Mar. 17, 1987, to the present inventor, Martin L. Lasker, details the construction of such reflectors.

Luminaire 50 further comprises a center reflector 64 that receives light from lamp 60 through a top aperture 65 in the basket reflector 62. Aperture 65 is large enough that a substantial portion of the otherwise wasted light output by lamp 60 upward is able to be directed toward the sides and then down and out. The center reflector 64 reflects such upward light to the sides and is split between two sides where a pair of side reflectors 66 and 68 can then direct the light out through lens 58. Some light from side reflectors 66 and 68 is used in a third reflection by a pair of tertiary reflectors 70 and 72 (FIGS. 9 and 10B) to obtain the desired pattern illumination.

Reflectors 64, 66, 68, 70 and 72 may be made of specular aluminum. Center reflector 64 has a bow-tie shape and is generally oriented orthogonal to and centrally above light source line segment 61. High reflectivity coatings and base materials can be used so that the reflectivity will exceed 94%. The intensity of light reflecting from reflectors 70 and 72 will thereby only be reduced to levels that still exceed 80% of that originally emitted by lamp 60. Reflector material considerations and efficiencies are dependent on the particular applications intended for luminaire 50 and should not be considered as limiting the present invention.

Light from lamp 60 that passes through top aperture 65, and that does not encounter center reflector 64, will be reflected by a top reflector 74 to a lens frame reflector 75 and a ring reflector 76. The ring reflector 76 is partially visible in FIG. 9, and has a saw-tooth shape that reflects the light to one side to avoid the basket reflector 62 and its associated structures Lens frame reflector 75 may be made by mirror polishing the inside surface of the lower housing 56, or it may be separately fabricated.

FIG. 10A provides a cross section of the luminaire 50 along the axis of the lamp and arc tube. FIG. 10B shows a cross-section through the lamp perpendicular to its axis. The light reflection paths are different in these two cross-sections.

In FIG. 10A, the top reflector 74 views the arc tube segment 61 as an elongated light source. Light rays directed toward the top reflector 74 include those rays that come from a section of the arc tube segment 61 which is on a side opposite of a center line and center point for the arc tube segment 61. The top reflector 74 converges these rays so that they cross at a distance from a cutoff lip 77 (FIGS. 9 and 10A) and then bounce off the ring reflector 76 to be emitted by the luminaire 50 at vertical angles as low as 60° from nadir.

The saw-toothed surface of the ring reflector 76 throws light in a non-radial direction so that it is not blocked by the basket reflector 62. Light rays coming from the center point of the arc tube segment 61 are also converged by the top reflector 74, but their crossing point is closer to the cutoff lip 77. The rays then travel to the lens frame reflector 75 which redirects them into a slightly fanned beam ranging from about 67° to 73° vertical. Since the lens frame reflector 75 extends below the basket reflector 62, this reflection does not have to be angled askew, and is instead in a true radial direction. Light rays coming from the section of the arc tube segment 61 which is closer to the reflecting surface than the center point converge at a point close to the cutoff lip 77 and are subsequently distributed at vertical angles up to 80°. There is an interrelated set of effects taking place. As the origin of the light rays moves from the far end of the arc tube segment 61 to the near end, the final vertical distribution angle of the light climbs from 60° to 80°, and the crossing point of the rays moves increasingly closer to the cutoff lip 77.

Light which originates near the closest end of the arc tube segment 61 would otherwise be distributed by the lens frame reflector 75 above the angle of 80°. The top reflector 74 directs this light at such an angle that it passes inside the cutoff lip 77 where it is stopped by the blocking wall 59. As a result, glare is precisely cut off at the desired angle of 80°, yet high intensities are emitted immediately below this angle to produce the broad throw of light necessary for wide spacing.

Such effects occur in more than the two directions along the lamp axis shown in FIG. 10A. The effects continue out at lateral angles from the lamp axis as long as the top reflector 74 sees the arc tube segment 61 as a sufficiently elongated source.

A point "W", in FIGS. 9 and 10A, is represented as a spot on the near end of the arc tube segment 61 and produces a light that is ultimately distributed at angles of 75° to 79° vertical. This point is located a distance "D" from the center point. In FIG. 9, a 55° lateral is represented and is seen by the top reflector 74 by the distance D from the center point, albeit slightly off center. The 55° lateral angle was carefully chosen.

While the broadside of the lamp perpendicular to the axis does not require much assistance from the reflector system, additional light is required as the lamp is seen, toward the corners of the light pattern, in a more foreshortened view. At 55° lateral from the lamp axis, 35° from broadside, a growing contribution from the reflector system is essential to reach out to the edge of the illumination pattern 12 with adequate illumination. The distance "D" is also critical. It has to be small enough to occur within the shortest arc tube segment 61 at 55° lateral, but not so far from the end as to waste the radiation of a large portion of the arc tube segment 61 due to the blocking action of wall 59.

FIG. 10B shows the operation of the top reflector 74 broadside of the arc tube segment 61. In this direction, the center reflector 64 covers a substantial portion of the top reflector 74. However, since the strong broadside radiation from the lamp does not require much augmentation from the reflector system, the remaining surface of the top reflector 74 interacting with the lens frame reflector 75 is sufficient to produce the desired light levels.

Figure 3:
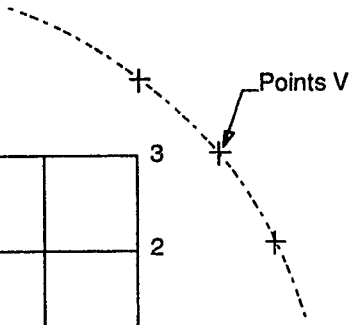
FIG. 3 shows the light distribution pattern of FIG. 2 superimposed over a grid of squares each having a side equal to one "mounting height" (MH), where one mounting height is the height of a luminaire above ground.
Figure 3:
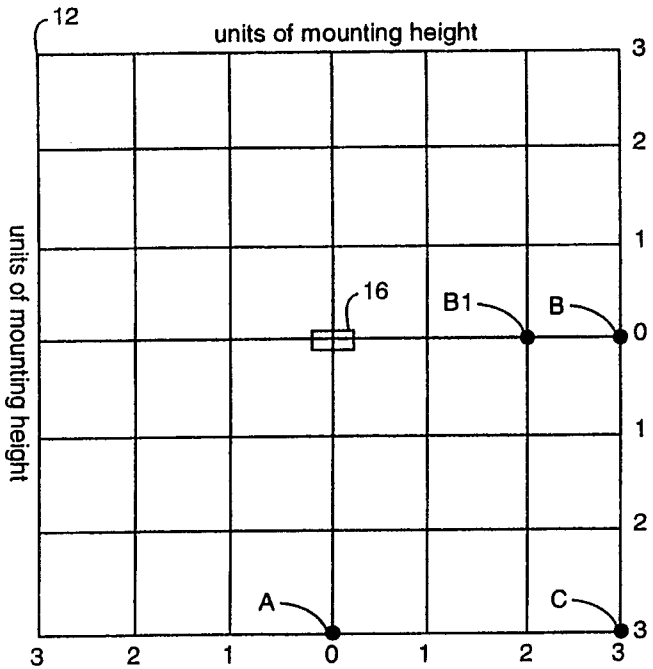

Various distribution angles are produced by the top reflector 74 and the lens frame reflector 75 as they pertain to points A, B, B1, C and N in FIG. 3. Point A, is broadside of the arc tube segment 61, and is at a vertical angle of 71.5° from the luminaire 50. The reflector train produces light toward point A at vertical angles from 67° to 73° effectively covering this area of the ground. A vertical angle of 77° is required to strike point C and near 77° to strike points on either side of it. Radiation from point W on the arc tube segment 61 is directed out toward point C at a vertical spread of 75° to 79°, again producing effective coverage.

Radiation from a part of the arc tube segment 61 near to and at the center point provides light on the ground closer to the luminaire 50 than the extreme corner of the pattern. Point B, in the on-end direction, is only at a vertical angle of 71.5° from the luminaire 50. While the reflector train redirects light from the center of the arc tube segment 61 to strike this point, it also redirects light from point W on the arc tube segment 61 to reach vertical angles ranging up to 79°.

This high angle distribution is not wasted because the arc tube segment 61 radiates so little light in an on-end direction, a major contribution from the reflector is not only required at point B, but also at point B1.

Figure 4:
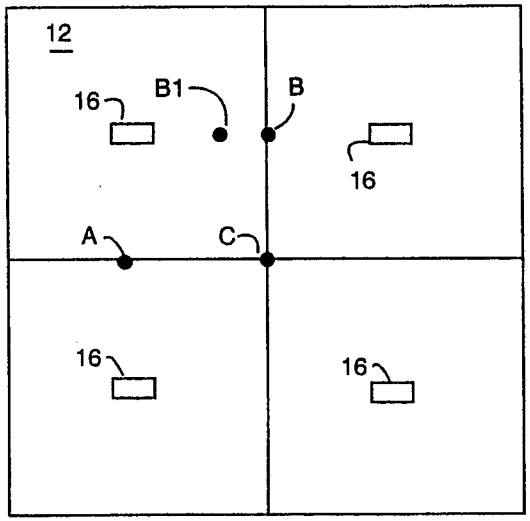
FIG. 4 shows four illuminated areas, such as the pattern of FIG. 2, abutting each other as is typical in a typical large parking lot application.

In the typical parking lot arrangement of four luminaires shown in FIG. 4, the light at point B will be the sum of the intensities from two luminaires. If no light was projected above 71.5°, the illumination at point B1 would have to come completely from only one luminaire, and the intensity of light from a single luminaire is not typically adequate to produce the required level. To add the necessary illumination at this point, a second luminaire has to project light at vertical angles of around 76°, and that is exactly the range of the beam coming from point W on the arc tube segment 61. For point N on the ground, no light at all is directed down beneath the luminaire 50 where it could add to a counter-productive creation of a hot-spot. The flat surface directly above the arc tube segment 61 is preferably painted black so as not to reflect light into this area.

Cutoff lip 77 and blocking wall 59 are cut away a few degrees beyond 55° lateral in a line parallel to the axis of the lamp. Since point W moves off the end of the longest arc tube, as seen by the top reflector 74 at about 62° lateral, there is no radiation beyond this angle that could be emitted above 80° vertical. The blocking wall 59 is therefore unnecessary and is eliminated to allow a clear passage for the light bouncing off the center reflector 64 and side reflector 66.

As illustrated in FIGS. 11A and 11B, side reflector 66 includes a plurality of faceted surfaces 78–88. Side reflector 68 is similarly constructed. Each facet is set at a compound angle which includes a canting angle with respect to the vertical and a lateral angle with respect to the horizontal axis of lamp 60 (where vertical and horizontal are as shown in FIG. 10B). Table I summaries the angles of the resulting light distribution, wherein facets 78–80 combine with tertiary reflectors 70 and 72 to direct light at the distribution angles marked by an asterisk (*).

TABLE I

| Facet | Lateral | Vertical |
|---|---|---|
| 78 | 0°* | 67° to 75.5°* |
| 79, 80 | 15°* | 67° to 75.5°* |
| 81, 82 | 45° | 70° to 78.5° |
| 83, 84 | 35° | 69° to 77.5° |
| 85, 86 | 25° | 68° to 76.5° |
| 87, 88 | 25° | 67° to 75.5° |

Light reflected from facets 78–80 is directed toward the tertiary reflectors 70 and 72, which, for example, includes a pair of facets 90 and 91 on tertiary reflector 70 (FIGS. 9 and 10B). Such light is therefore reflected three times before exiting luminaire 50 to achieve a lateral angle in the range of 0° to 15°, compared to the axis of lamp 60.

Since very little light from lamp 60 can be radiated from the ends of light source line segment 61, the reflected light from tertiary reflectors 70 and 72 compensate by contributing to the outside edges of the square area of illumination in the direction of the ends of light source line segment 61.

The tertiary reflectors 70 and 72, and the side reflectors 66 and 68 are recessed in their housing 52 and 56 behind the clear glass lens 58 and cannot direct light out at angles higher than 78°.

The various facets in reflectors 66 and 68 produce the necessary lateral and vertical distributions of light. Facet 78 of the side reflector 66 reflects light from the center reflector 64 at the same vertical angles as it is received. The light is sent to the tertiary reflector 72 which drops the vertical angle 3° and bends the lateral angle 90° so that the light is emitted from the luminaire 50 in an "on-end" direction. Facets 79 and 80 also throw a vertically unchanged reflection toward the tertiary reflector which again drops the vertical angle 3° and distributes the light laterally with its greatest intensity aimed at 15° from end on. Facets 81 and 82 kick the reflection upward 3° and throws it directly out of the luminaire 50 aimed at 45° lateral. Facets 83 and 84 kicks the reflection up only 2° vertically in a 35° lateral direction. Facets 85 and 86 lift the reflection 1° and distribute it at 25°. Facets 87 and 88 do not change the vertical angle and distributes the light at 25° lateral. These lateral distributions overlap-somewhat and therefore are essentially continuous from on-end to 45°.

Figure 5:
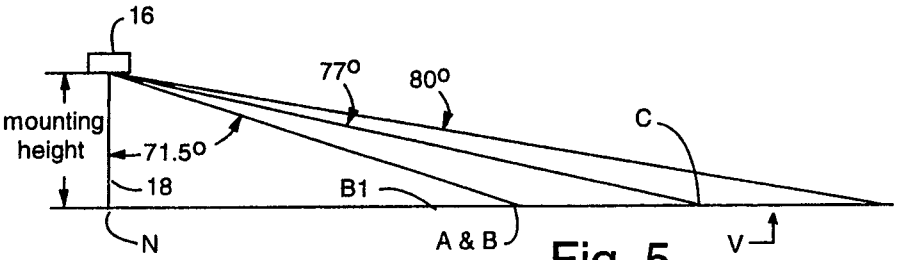
FIG. 5 is an elevation view of the luminaire of FIG. 2 and a pole beneath it that is one mounting height tall.
Figure 6:
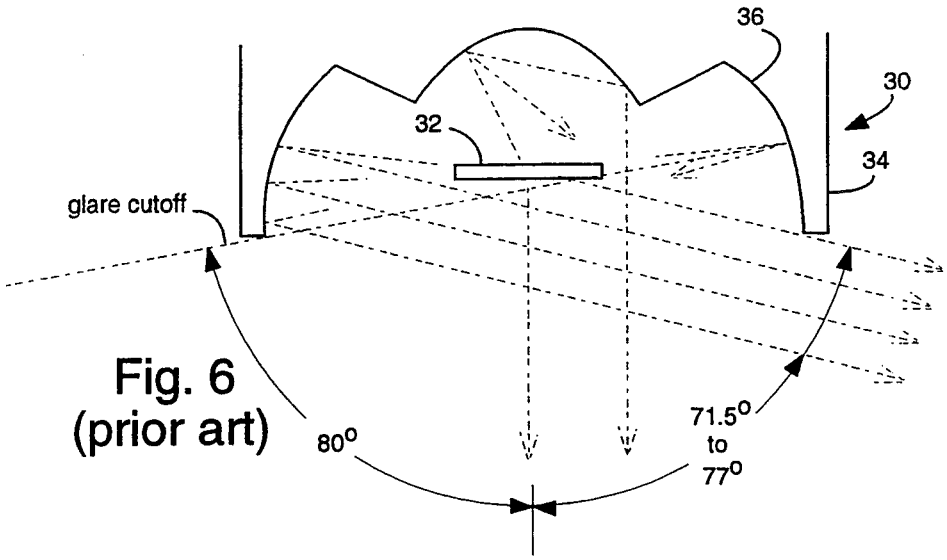
Fig. 6 (prior art)
FIG. 6 illustrates the performance of a prior art luminaire with an opaque housing in which a horizontal lamp system has an arc tube in a horizontal position.
Figure 7:
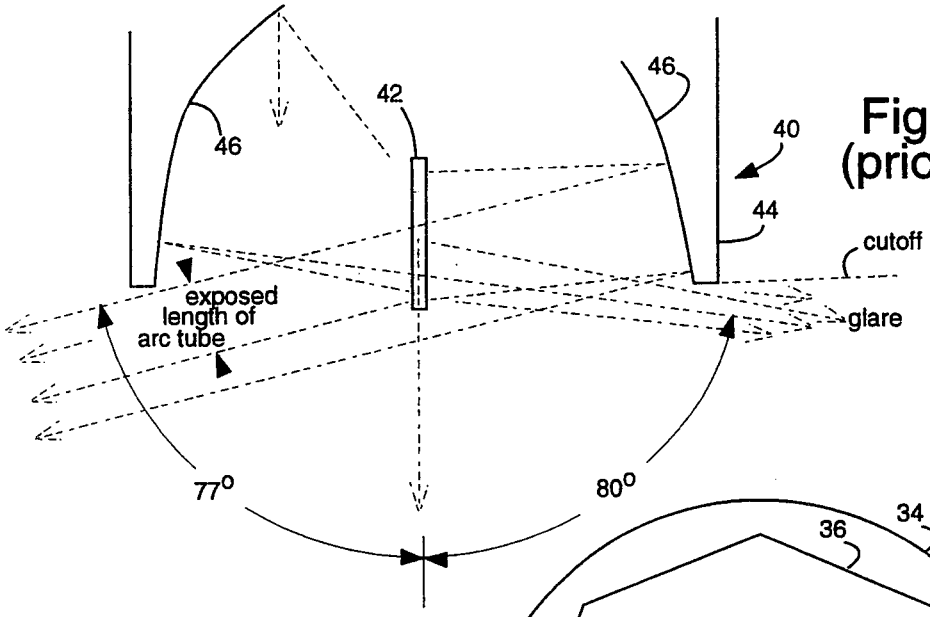
Fig. 7 (prior art)
FIG. 7 illustrates the performance of a prior art luminaire with an opaque housing in which a lamp system has an arc tube in a vertical position.
Figure 8:
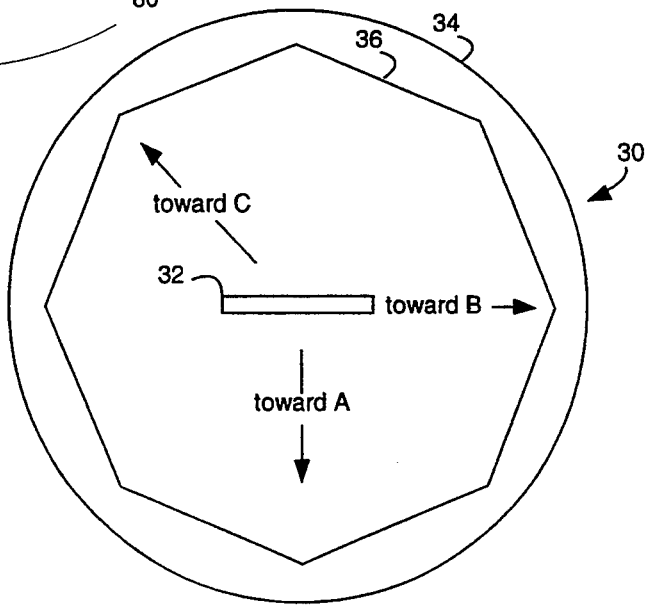
FIG. 8 illustrates the relative directions in plan view for the luminaire of FIG. 6 to points B and C (e.g., FIG. 5)

To strike point B (FIGS. 3–5) on the ground, a point three mounting heights from the luminaire requires a vertical distribution angle of 71.5°. This is in the range produced by the interaction of facet 78 and the tertiary reflector, laterally aimed at point B. Point C is at the corner of square pattern three mounting heights by three mounting heights from the luminaire 50, and requires a vertical angle of 77°. Again this is in the range of facets 81 and 82 aimed at 45° lateral. In the same way the other facets distribute their lights as needed to illuminate the outer edge of the square pattern, as large as six mounting heights by six mounting heights spacing between luminaires. The optical train of the center reflector, side reflector and tertiary reflector provides a precise control at all lateral angles to cut off undesirable brightness above 80° vertical.

Sagged glass is preferably used for lens 58. Because of the index of refraction, flat glass would reflect back a significant portion of the light trying to pass through it at the very acute, high angles of distribution and therefore can not produce the same uniformity with wide spacing. Lamp 60 may be a high-wattage 1000 watt type BT-37 lamp (Venture) or a 750 watt, 110,000 lumens type (Sylvania).

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A luminaire for providing a square-shaped illumination pattern from above onto a surface below, comprising:

an elongated arc tube (61) for providing a source of light in a plurality of radiant directions including a broadside and to a lesser extent toward its opposite ends, wherein a first and second opposite sides of said square-shaped illumination pattern are oriented broadsides to the elongated arc tube and a pair of remaining third and fourth opposite sides of said square-shaped illumination pattern are oriented on-end to the elongated arc tube;

a basket reflector (62) that encircles the elongated arc tube (61) in a plane parallel to an axis of elongation of the elongated arc tube (61) and that includes an opening (65) above the elongated arc tube (61) and a pair of cutoff lips (77) oppositely positioned on a blocking wall (59) on its outer perimeter and in-line with an axis of elongation of the elongated arc tube;

a ring reflector (76) that encircles both the elongated arc tube (61) and the basket reflector (62) in a plane above and parallel to said arc tube axis, and including a saw-toothed surface to direct light in a non-radial direction to avoid the basket reflector (62);

a lens frame reflector (75) positioned below the ring reflector (76) and encircling the elongated arc tube (61) in a plane parallel to said arc tube axis and placed below the basket reflector (62);

a top reflector (74) centrally positioned above the elongated arc tube (61) and opposite to said surface to be illuminated, for converging light rays from the elongated arc tube (61) to cross at a distance from said cutoff lip (77) and then to reflect off the ring reflector (76) to be emitted by the luminaire at vertical angles as low as 60° from nadir, and for directing light rays coming from near a center point of the arc tube (61) to converge in a crossing point closer to the cutoff lips (77) to then travel to the lens frame reflector (75) which redirects them into a slightly fanned beam ranging from approximately 67° to 73° vertical, and for directing light rays coming from a section of the arc tube (61) which is closer to the reflecting surface than the center point to converge at a point proximate to the cutoff lips (77) and to be subsequently distributed at vertical angles up to 80°, wherein light emitted from near the far ends of the arc tube (61) and that have a final vertical distribution angle that ranges from 60° to 80° causes a crossing point of such rays to come increasingly closer to said cutoff lips (77), and wherein at light distribution angles that would otherwise 80° the top reflector (74) directs this light at such an angle that it passes inside the cutoff lips (77) and is stopped by said blocking wall (54) to precisely cut off glare at an angle of 80° and yet emit high intensities of light immediately below this angle to produce a broad throw of light necessary for wide spacing of adjacent luminaires.

2. The luminaire of claim 1, further comprising:

a center reflector (64) having an elongated shape oriented orthogonally to the elongated arc tube and above it and in front of the top reflector.

3. The luminaire of claim 1, wherein:

the elongated arc tube (61) has a point "W" which is a spot on a near end of the arc tube that produces light that is ultimately distributed at angles of 75° to 79° vertical, said point "W" being located a distance "D" from a center point of the elongated arc tube (61), such that at an angle of 55° lateral from said arc lamp axis, there is a growing contribution of reflected light emitted out of the luminaire to reach out to the edges of said illumination pattern, and wherein the distance "D" is short enough to occur within the shortest of a limited range of arc tubes at 55° lateral and not so long as to waste a substantial portion of the radiation of a largest of arc tubes due to the blocking action of said blocking wall (59).

4. The luminaire of claim 3, wherein:

the top reflector (74) and the lens frame reflector (75) direct light toward a point "A" at a center of said first and second opposite sides of said square-shaped illumination pattern at vertical angles from 67° to 73°, and at a vertical angle of 77° to strike a point "C" at the four corners of said square-shaped illumination pattern, wherein light radiation from said point "W" on the arc tube is directed out toward said point "C" at a vertical spread of 75° to 79°, wherein radiation from a part of the arc tube (61) proximate to a center point provides light closer to the luminaire than the extreme corner of the pattern; and the top reflector (74) and the lens frame reflector (75) direct light toward a point "B" at a center of said third and fourth opposite sides of said square-shaped illumination pattern at a vertical angle of 71½° and to also redirects light from said point "W" to reach vertical angles that range up to 79°.

5. The luminaire of claim 3, further comprising:

a center reflector (64) having an elongated shape oriented orthogonally to the elongated arc tube and above it and in front of the top reflector; and a pair of side reflector (66 and 68) to reflect light from the center reflector (64) at the same vertical angles as it receives it, that directs light to a pair of tertiary reflectors (70 and 72) that drop the vertical angle approximately 3° and bends the lateral angle approximately 90°, providing for an emission of the light from the luminaire in the direction of said arc lamp axis.

6. The luminaire of claim 5, wherein:

the pair of side reflectors (66 and 68) include facets (79 and 80) to direct light in a vertically-unchanged reflection toward said tertiary reflectors (70 and 72) for a dropping of the vertical angle 3° and a distribution light laterally with its greatest intensity aimed at an angle of approximately 15° from said arc tube axis.

7. The luminaire of claim 5, wherein:

the pair of side reflectors (66 and 68) include facets (81 and 82) to direct light upward approximately 3° and out of the luminaire aimed at 45° lateral.

8. The luminaire of claim 5, wherein:

the pair of side reflectors (66 and 68) include facets (83 and 84) to direct light upward approximately 2° and out of the luminaire aimed at 35° lateral.

9. The luminaire of claim 5, wherein:

the pair of side reflectors (66 and 68) include facets (85 and 86) to direct light upward approximately 1° and out of the luminaire aimed at 25° lateral.

10. The luminaire of claim 5, wherein:

the pair of side reflectors (66 and 68) include facets (87 and 88) to direct light at approximately 0° and out of the luminaire aimed at 25° lateral.

11. The luminaire of claim 5, wherein:

the pair of side reflectors (66 and 68) include facets (79 and 80) to direct light in a vertically-unchanged reflection toward said tertiary reflectors (70 and 72) for a dropping of the vertical angle 3° and a distribution light laterally with its greatest intensity aimed at 15° from end on;

the pair of side reflectors (66 and 68) include facets (81 and 82) to direct light upward approximately 3° and out of the luminaire aimed at 45° lateral;

the pair of side reflectors (66 and 68) include facets (83 and 84) to direct light upward approximately 2° and out of the luminaire aimed at 35° lateral;

the pair of side reflectors (66 and 68) include facets (85 and 86) to direct light upward approximately 1° and out of the luminaire aimed at 25° lateral; and the pair of side reflectors (66 and 68) include facets (87 and 88) to direct light at approximately 0° and out of the luminaire aimed at 25° lateral, wherein such lateral distributions overlap somewhat and are essentially continuous from end-on to 45° lateral.

12. The luminaire of claim 5, wherein: said cutoff lip (77) and said blocking wall (59) are cut away a few degrees beyond 55° lateral in a line parallel to said arc lamp axis, to account for a moving off of said point "W" off the end of the arc tube (61), as seen by the top reflector (74), wherein light that could be emitted above 80° vertical is blocked at approximately 62° lateral, and a portion of said blocking wall (59) is removed to allow clear passage for the light reflecting off the center reflector (64) and the side reflectors (66 and 68).

* * * * *